US006921445B2

(12) United States Patent
Albrecht et al.

(10) Patent No.: US 6,921,445 B2
(45) Date of Patent: Jul. 26, 2005

(54) METHOD FOR INSULATING A HIGH-TC-SUPERCONDUCTOR AND THE USE OF SAID METHOD

(75) Inventors: Cord Albrecht, Erlangen (DE); Robert Greiner, Baiersdorf (DE); Peter Kummeth, Herzogenaurach (DE); Peter Massek, Forchheim (DE); Manfred Ochsenkühn, Berg (DE)

(73) Assignee: Siemens Aktiengesellschaft, Munich (DE)

( * ) Notice: Subject to any disclaimer, the term of this patent is extended or adjusted under 35 U.S.C. 154(b) by 310 days.

(21) Appl. No.: 10/129,529

(22) PCT Filed: Jan. 30, 2001

(86) PCT No.: PCT/DE01/00355

§ 371 (c)(1),
(2), (4) Date: May 7, 2002

(87) PCT Pub. No.: WO01/61712

PCT Pub. Date: Aug. 23, 2001

(65) Prior Publication Data

US 2002/0190419 A1 Dec. 19, 2002

(30) Foreign Application Priority Data

Feb. 15, 2000 (DE) ..... 100 06 537

(51) Int. Cl.[7] ..... H01B 13/14; H01B 12/14

(52) U.S. Cl. ..... 156/51; 505/434; 505/470; 427/62

(58) Field of Search ..... 156/47, 51; 29/599; 505/434, 470; 427/62

(56) References Cited

U.S. PATENT DOCUMENTS 3,893,642 A 7/1975 Van Vlaenderen
4,489,130 A 12/1984 Hilker
5,866,195 A * 2/1999 Lemelson ..... 427/62

FOREIGN PATENT DOCUMENTS

DE 2 022 802 11/1971
DE 2 110 934 6/1973
DE 2 345 779 3/1974

(Continued)

OTHER PUBLICATIONS

B. Fischer, "Fabrication and properties of Bi–2223 tapes", IEEE Transactions on Applied Superconductivity, vol. 9, No. 2, Jun. 1999, pp. 2480–2485.

Martin N. Wilson, "Superconductivity and Accelerators: the Good Companions", IEEE Transactions on Applied Superconductivity, vol. 9, No. 2, Jun. 1999, pp. 111–121.

Cord Albrecht et al., "The Euratom Magnet", Siemens Review 4/88, pp. 32–37.

M. Leghissa et al., "Bi–2223 Multifilament Tapes and Multistrand Conductors for HTS Power Transmission Cables", IEEE Transactions on Applied Superconductivity, vol. 7, No. 2, Jun. 1997, pp. 335–358.

*Primary Examiner*—John T. Haran
(74) *Attorney, Agent, or Firm*—Harness, Dickey & Pierce, P.L.C.

(57) ABSTRACT

A method involves sheathing a superconductor with a thermoplastic insulation material on all sides. The conductor exits a guide channel that extends in the propulsion direction. A melt hose is extruded from the molten insulation material in the propulsion direction and through a nozzle that has an outlet which embraces the conductor, whereby a distance is kept on all sides. The melt hose is stretched via the propulsion of the conductor. The hose is drawn to the surface of the conductor and is compacted by cooling. The method can especially be used for sheathing band-shaped high-$T_c$-superconductors. Materials having processing temperatures between 200° C. and 450° C., are selected as thermoplastic insulation materials.

39 Claims, 2 Drawing Sheets

FOREIGN PATENT DOCUMENTS

| | | | |
|---|---|---|---|
| DE | 2 409 655 | | 9/1974 |
| DE | 26 38 763 | | 1/1978 |
| DE | 3207083 | A1 | 9/1983 |
| DE | 38 23 938 | C2 | 2/1990 |
| DE | 3826219 | A1 | 2/1990 |
| DE | 40 10 306 | A1 | 10/1991 |
| EP | 0 292 126 | B1 | 11/1988 |
| FR | 2 091 363 | | 5/1971 |
| GB | 2 140 195 | A | 11/1984 |
| WO | WO 00/11684 | | 3/2000 |

* cited by examiner

METHOD FOR INSULATING A HIGH-TC-SUPERCONDUCTOR AND THE USE OF SAID METHOD

This application is the national phase under 35 U.S.C. § 371 of PCT International Application No. PCT/DE0100355 which has an International filing date of Jan. 30, 2001, which designated the United States of America, the entire contents of which are hereby incorporated by reference.

FIELD OF THE INVENTION

The invention generally relates to a method for insulating a superconductor.

BACKGROUND OF THE INVENTION

The subject matter of WO 00/11684, not published before the priority date of the present application, discusses a method for producing a sheathing made of an electrical insulating material of plastic on all sides around at least one superconductor with high-$T_c$ superconductor material. According to this proposed method, it is intended to provide a continuous sheathing process at a process temperature having virtually no detrimental effect on the superconducting properties of the conductor by

- the conductor emerging from a guide channel extending in a direction of advancement,
- extruding a melt tube of molten thermoplastic insulating material in the direction of advancement from a die, the outlet opening of which surrounds the conductor at a distance on all sides,
- the melt tube being stretched and drawn onto the surface of the conductor as the conductor is advanced and
- the melt tube applied in this way to the surface of the conductor being made to set by cooling.

This proposed method is intended to be used in particular for sheathing a superconductor in strip form with an aspect ratio of at least 3, preferably at least 10.

To allow them to be used in electrical devices, such as windings of machines, transformers, magnets or cables, industrial superconductors must generally be provided with an electrical insulation. Such a requirement also exists in particular in the case of conductors with oxidic high-$T_c$ superconductor material (HTS material). In this case it is intended that such HTS conductors, which may be of a wire form (with circular cross section) and in particular of a strip form (with rectangular cross section), can be provided continuously with an insulating sheathing in a method which is simple to carry out. The method is intended in this case to be suitable both for single-conductor insulation and for the insulation of an HTS conductor construction in the form of a multiple conductor, which is composed of individual superconducting conductors, or a composite conductor with superconducting and normally conducting parts.

There have not in the past been any known methods realized on an industrial scale by which a superconductor or conductor construction with HTS material can be provided on all sides with an insulating sheathing while it continuously runs through. One of the reasons for this is that the currently pursued HTS conductor concepts provide a strip form with an unfavorably high aspect ratio (=ratio of conductor width to conductor thickness) with regard to insulating methods practiced in superconducting technology. This is so because it is only possible with difficulty for such conductors to be uniformly coated with a small thickness of an insulating material by the known methods. In the case of an HTS conductor disclosed by EP 0 292 126 B1, the sheathing is therefore made relatively thick.

Classic coating methods have previously been unsuitable for HTS conductors because they can lead to a current degradation of the conductor, which is the consequence of the high process temperatures, required for these methods, and of supercritical bending stresses, which occur when the conductor is passed periodically through immersion baths with multiple deflection by corresponding deflecting rollers.

To make it possible for known HTS strip conductors in strip form to be used in the construction of magnetic windings, for example, in the past separate insulating films, for example of a special aromatic polyamide known by the trade name "Kapton", and having a thickness of, for example, 50 $\mu$m, have been wound together with the strip conductor. Consequently, apart from an unwinding device for the conductor, a corresponding device for the insulating film has to be additionally provided for the production of windings, in order to produce an insulation between the individual layers or turns of a winding. In this case, the difficulty may arise that the conductor is not completely sheathed by the insulating film. Furthermore, there is in each case only one separating layer between the individual conductor layers, with the lateral edges of the conductor remaining uninsulated. To ensure reliable insulation in these regions also, either casting of the wound assembly with casting resin or the use of insulating films wide enough for a short-circuit between the conductors to be prevented by a lateral overhang of the film beyond the respective conductor edges is necessary. However, the adjusting effort to make it possible for the conductor and insulating film to be wound in parallel is relatively high.

In addition, it is known from the technique of insulating superconductors with what is known as classic superconductor material, which require an LHe cooling technique, to wrap a superconductor in strip form, for example, with a corresponding film of plastic (cf. DE 23 45 779 A or DE 38 23 938 C2). These methods can also only be carried out with relatively great effort. Furthermore, the films used must been of a sufficient thickness to rule out mechanical damage during the wrapping process.

Furthermore, it is also to be regarded as extremely difficult to spin insulating strip or insulating filaments around the very small cross sections of current HTS strip conductors with their typically large aspect ratio.

In the method according to WO 00/11684, not published before the priority date of the present application, for which the method features stated at the beginning are proposed, the application of a sheathing of thermoplastic insulating material takes place by using a thin-film extrusion technique based on what is known as a tube-stretching method. In this case, a melt tube is extruded from a die, which is larger in its dimensions than the conductor to be sheathed, which runs through a central guide channel in the center of the die. This produces a tube around the conductor, which is stretched, i.e. elongated, by the advancement of the conductor, until the final, desired thickness of the sheathing wall (insulating layer) is reached. This tube is drawn onto the surface of the conductor. Depending on the insulating material used, what is known as the degree of stretching, i.e. the stretching of the material, is in this case generally between 5 and 15. The stretching may advantageously take place with a vacuum simultaneously acting in the interior of the tube. Together with advantageous preheating of the conductor before entry into the guide channel and/or during the drawing of the conductor through the latter, in this way a particularly good and bubble-free bonding fit of the sheathing on the superconductor can be produced. The slow cooling then taking place, for example in air, brings about a solidification and stress-free setting of the melt of the insulating material on the conductor.

With this method, relatively thin (of a minimum thickness of approximately 40 μm and/or a maximum thickness of 100 μm) and defect-free sheathing layers can consequently be realized on superconductors of in fact any cross-sectional form, in particular however of strip form.

Known in principle are coating installations via which insulating sheathings of a thermoplastic material are to be applied to wires (cf. DE 26 38 763 A) through stripping dies, by pressure sheathing or by the tube-stretching method (DE 24 09 655 A, 20 22 802 A, DE 21 10 934 A). The wires may in this case consist in particular of steel (cf. U.S. Pat. No. 3,893,642), A1 (cf. DE 24 09 655 A) or Cu (cf. U.S. Pat. No. 4,489,130 or the cited DE 21 10 934 A) and generally have circular cross-sectional surface areas.

The coating method to be performed with such installations is also referred to as extrusion coating.

The proposed method is based on the realization that the aforementioned methods, known per se, are suitable for the coating of oxidic HTS conductors, allowing the conductor-specific difficulties mentioned at the beginning to be avoided. This is of significance, in particular, in the case of a strip form of the superconductor. In this context, a strip form is to be understood as meaning any desired rectangular form with angular or rounded edges. Preferably, however, the rectangular form may have a relatively large aspect ratio, generally above 10, as is the case in particular with known thin HTS strip conductors. By coating on the basis of the proposed tube-stretching method, pore-free insulating layers which adhere well on the surfaces typical of HTS conductors can be realized.

Applying this method to oxidic HTS conductors with their typical thermal and mechanical sensitivity opens up an extended area of applications for these types of conductors on account of the easier usability of already preinsulated conductors. Furthermore, considerable cost savings can be expected in comparison with the methods previously used in superconducting technology. Apart from the savings resulting from an efficient, rapid extrusion technique, there is considerable potential for rationalization in the usable insulating materials, which are significantly less expensive in comparison with known insulating films.

With the proposed method, continuous coating of an HTS conductor is possible, since the insulating material can be transported from a storage container which can be replenished at any time. Furthermore, with the method, the thickness of the insulating sheathing can be set variably in a wide range and with sufficient accuracy.

Since, for example, each individual conductor can be completely insulated, there is double insulation reliability in the case of strip conductor windings, because the conductors are separated by a twofold insulating layer. Furthermore, the use of different thermoplastic materials allows the combination of mechanical and thermal properties of the sheathing to be adapted to the respective application. In addition, the proposed method is significantly faster than a classic spinning or coating method previously used for metallic superconductors.

Furthermore, in the proposed method, the lateral conductor edges are also insulated, reducing the risk of short-circuits in this region. The insulation is also suitable in particular for thin strip conductors with an unfavorable aspect ratio. In this case there is no longer the risk feared when using coating methods of "edge recession", i.e. undesired extreme thinning of the layer in the region of edges with small edge radii, as exist precisely in the case of thin conductor strips.

Furthermore, in the proposed method, the HTS conductor need not be mechanically loaded too much. This is because the mechanical loading is restricted to the small pulling forces produced by conductor unwinders or winders. The deflection of the conductor during the coating process can thus be advantageously avoided.

In the proposed method, known thermoplastic materials with a relatively low processing or melting temperature of below 200° C. are to be used and only relatively brief heating of the conductors is provided, to avoid, at least to a great extent, degradation of the superconducting properties (with respect to the critical temperature $T_c$ and in particular with respect to the critical current density $J_c$, to be measured in $A/m^2$). Proposed as thermoplastic materials suitable for this are polyethylenes, polystyrene-ethylene-butylene elastomers, polyurethane elastomers, ethylene/vinyl acetate copolymers or acrylic acid/acrylate copolymers.

With the thermoplastics listed above, insulating layer thicknesses of minimally about 40 to 50 μm can be realized. However, to achieve an effective current density that is as high as possible in a high-$T_c$ superconductor and/or a device constructed with such conductors, such as for example a superconducting winding, the insulating layer should be smaller than this. In this case it should be possible to ensure good bonding of the insulating material on the conductor and good coupling of the corresponding insulating layer to impregnating and casting resins. It is found, however, that, with the proposed insulating materials, the production of what are known as Roebel bars (cf. for example DE-C 277012 or "Siemens Review", Vol. 55, No. 4, 1988, pages 32 to 36, or "IEEE Transactions on Applied Superconductivity", Vol. 9, No. 2, June 1999, pages 111 to 121), for example, is problematical, since these insulating materials are relatively soft at room temperature and have a high friction coefficient.

SUMMARY OF THE INVENTION

It is therefore the object of an embodiment of the present invention to improve the proposed method to the extent that at least one of the aforementioned difficulties is avoided. Furthermore, special uses of the method are to be specified.

An object relating to the method can be achieved according to an embodiment of the invention by a method for producing a sheathing. Accordingly, a method, according to an embodiment of the invention, for producing a sheathing made of an electrical insulating material of plastic on all sides around at least one superconductor with oxidic high-$T_c$ superconductor material provides that, for a continuous sheathing process at a process temperature having virtually no detrimental effect on the superconducting properties of the conductor, the conductor emerges from a guide channel extending in a direction of advancement, a melt tube of molten thermoplastic insulating material is extruded in the direction of advancement from a die, the outlet opening of which surrounds the conductor at a distance on all sides, the melt tube is stretched and drawn onto the surface of the conductor as the conductor is advanced and the melt tube applied in this way to the surface of the conductor is made to set by cooling. In this case, a thermoplastic material with a process temperature between 200° C. and 500° C., preferably between 220° C. and 450° C., is to be provided as the insulating material. A process temperature having virtually no detrimental effect on the superconducting properties of the conductor is understood in this context as meaning a temperature which leads at most to a degradation of the critical current density $J_c$ [in $A/m^2$] of less than 10%.

Suitable as corresponding thermoplastics are, in particular, special engineering thermoplastics such as polyamides and polyesters and, in particular, also high-temperature thermoplastics (HT thermoplastics) such as polyether imide (PEI), polyether sulfone (PES), polysulfone (PSU), polyphenylene sulfone (PPSU) and polyether ether ketone (PEEK).

This is so because it has been found that HTS strip conductors, in particular with filaments of Bi cuprate material and embedment of the filaments in an Ag matrix, surprisingly withstand temperature loads of at least 500° C. for several minutes without any detrimental effect on their superconducting properties, such as in particular their current-carrying capacity. This makes use of the thermoplastics to be chosen according to the invention possible. It is additionally of advantage in this case that the thermoplastics chosen according to the invention, in particular the HT thermoplastics PEI, PPSU and PEEK, have very good electrical properties and extremely good low-temperature properties, i.e. are distinguished by good flexibility and toughness at low temperatures. By comparison, other thermoplastics often exhibit a strong tendency to become brittle at low temperatures. A further advantage over the thermoplastics proposed by the earlier application is an improved adhesion bonding on ceramic and metallic substrates, to be achieved in a designated temperature range, on account of the decidedly polar character of these materials and the significantly better compatibility with and coupling to epoxy (EP) and unsaturated polyester resins (UP resins), which are used as casting and impregnating compounds for device using such superconductors.

Furthermore, the thermoplastics to be chosen according to an embodiment of the invention advantageously have at room temperature a high modulus of elasticity (>3000 MPa), a high surface hardness (Rockwell hardness≧120; R scale) and a low friction coefficient (<0.6). Given as a comparison are the corresponding values for ethylene vinyl acetate (EVA), which is cited in the earlier application: modulus of elasticity<400 Mpa, surface hardness Shore D<40 and friction coefficient>1. This profile of mechanical and tribological properties of the chosen thermoplastics also makes it possible for Roebel conductors to be produced unproblematically. This is a further great advantage over the thermoplastics cited in the earlier application, with which the production of Roebel conductors is not possible, or only with considerable effort. This is so because, in the production of Roebel conductors, the insulating layer must ensure adequate sliding characteristics, since the individual conductors are grouped together to form a conductor assembly, for example by means of binding with tape, causing a relative movement of the individual conductors with respect to one another. Owing to the high friction coefficient and the low surface hardness of the plastics listed in the earlier application, the individual conductors cannot slide with respect to one another; deformations of the insulating layer, which may lead to tearing open of the insulating layer, occur.

A considerable advantage of the use of the novel insulating materials lies in the significant reduction in the insulating layer thickness. The good processing properties of these plastics in the tube-stretching process allow insulating layer thicknesses of the sheathing of less than 100 μm, preferably in the range of 15 to 30 μm and below, to be realized, for example average thicknesses of at most 30 μm. This is important to achieve a high effective current density in the conductor. Compared with the materials according to the earlier application, where it was preferred to work with a layer thickness of about 50 μm, this is a reduction in the layer thickness of over 50%. The combination of good processing behavior and the abovementioned profile of mechanical and tribological properties makes possible the reliable and unproblematical production preferably of Roebel conductors with insulating layer thicknesses of 15 to 30 μm with a high effective current density.

An HTS conductor for which the method according to an embodiment of the invention can be applied is to be understood here as meaning not only an individual conductor, but also a composition/combination of a plurality of such conductors or parts of them. The conductor may in this case contain at least one conductor core of the superconductor material.

A superconductor coated according to the invention with an insulating sheathing may be used without additional insulating film. There is consequently no longer the production effort caused by winding an insulation at the same time.

Thus the method according to an embodiment of the invention can be advantageously used not only for forming sheathings with approximately uniform thickness on all sides. Rather, there can also be provided an outlet opening of the die shaped such that its spacing with respect to the conductor is non-uniform, seen in the circumferential direction of the latter. In this way it is possible in particular for specific spacings between neighboring conductors, for example within a conductor assembly or a winding, to be fixed.

The method according to the invention is used particularly advantageously for sheathing a superconductor in strip form with an aspect ratio of at least 3, preferably at least 10. Specifically superconductors of this type, which may moreover only have a small thickness, can only be coated with difficulty by known coating methods, and only with the risk of the mentioned edge recession.

The method according to the invention can also be used equally well for the sheathing of superconducting multiple or composite conductors. Conductors of this type have a construction comprising a plurality of superconducting conductor parts or conductor regions, with at least one single superconducting conductor or such a conductor core being provided. Precisely such a construction can be provided with an insulating sheathing particularly easily and uniformly by the method according to an embodiment of the invention, without the risk of any detrimental effect on the conductor properties of the superconductor material. These types of conductor may also be of a strip form.

With regard to good bonding of the selected thermoplastic insulating material on the HTS conductor, heating up of the latter before or during its introduction into the guide channel is advantageously provided. The heating-up temperature should in this case preferably be at least approximately the process temperature (permissible deviation: +/−50° C).

Further advantageous refinements of the method according to an embodiment of the invention and the use of this method emerge from the other aspects of the invention.

BRIEF DESCRIPTION OF THE DRAWINGS

The invention is further explained below on the basis of exemplary embodiments, including the drawings, wherein.

In the figures, corresponding parts are provided with the same reference numerals. Parts not represented are generally known.

DETAILED DESCRIPTION OF THE PREFERRED EMBODIMENTS

Figure 2:
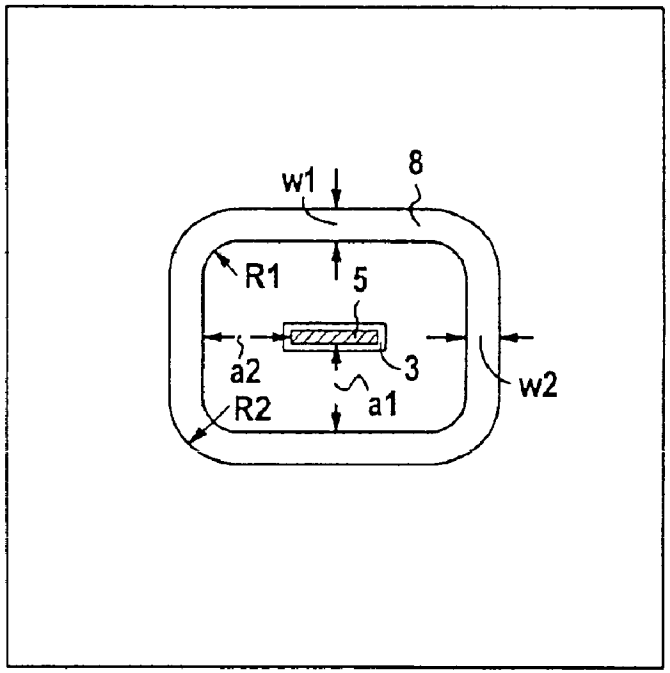
FIGS 1 and 2 thereof show a die of an installation for carrying out the method according to the invention schematically in each case, as a longitudinal section and in front view, respectively, and FIG. 3 thereof shows an installation for the extrusion coating of an HTS conductor with a die as shown in FIGS. 1 and 2.
Figure 1:
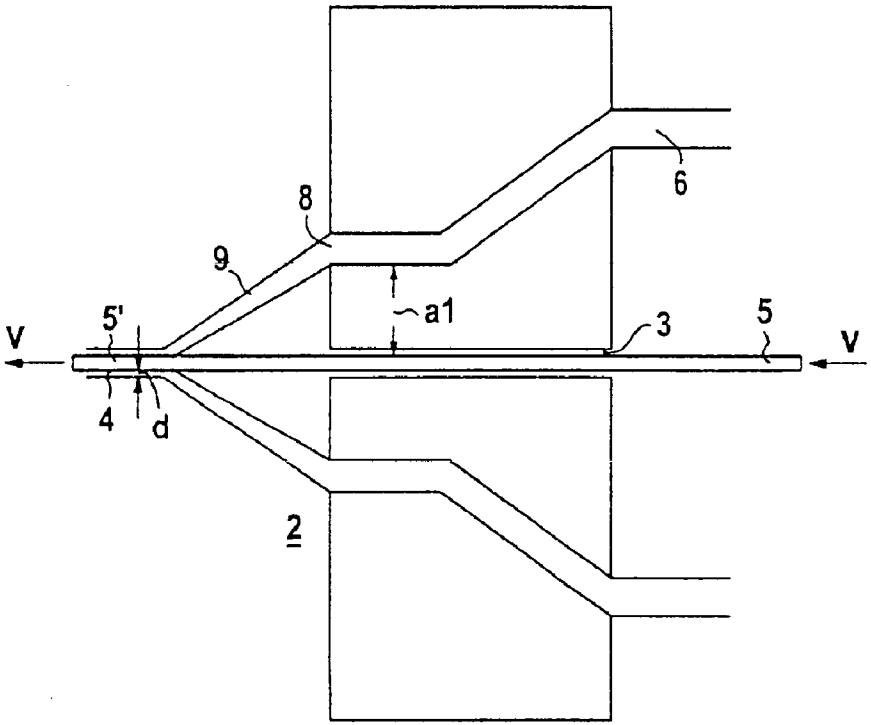

In an installation to be provided for carrying out the method according to an embodiment of the invention, devices known per se are assumed, as used for the sheathing of non-superconducting wires with plastics materials using extrusion coating on the basis of what is known as the tube-stretching method (cf. the cited U.S. Pat. No. 3,893,642 or the cited DE-A documents 2 022 802 and 21 10 934). A corresponding installation (cf. FIG. 3) comprises what is known as an extruder with an extrusion head, which has an extrusion die, which is illustrated in FIGS. 1 and 2 in longitudinal section and in front view, respectively. This die, denoted generally by 2, centrally contains a guide channel 3. A superconductor 5, to be provided with an electrically insulating sheathing 4, is to be passed through this channel in a direction of advancement, indicated by an arrow v, with the aid of advancing means not represented (cf. FIG. 3). According to the assumed exemplary embodiment, the superconductor 5 is an HTS conductor in strip form. This conductor may advantageously be preheated before introduction into the guide channel 3.

If need be, instead of or in addition to this, the guide channel itself can be heated up.

The insulating material of the sheathing 4 is melted in the extruder not represented (cf. FIG. 3), transported into the extrusion head with a manifold system and forced as melt 6 into a die gap 7 of the extrusion die 2. At an outlet opening 8 of the die gap 7, the gap width of which is significantly larger there than the final thickness d of the sheathing 4 around the strip conductor 5, there emerges, seen in the direction of advancement v, a melt tube 9, which is stretched in the form of a stretched cone on account of fixing of its cone tip on the strip conductor and is applied to the conductor with the layer thickness d required on the strip conductor. A vacuum advantageously applied at the guide channel 3 produces inside the stretched cone a negative pressure which prevents air bubbles from being trapped between the sheathing and the conductor and, together with the preheating of the conductor, ensures a good bonding fit of the sheathing 4 on the conductor. The strip conductor sheathed in this way is denoted in FIG. 1 by 5'.

As FIG. 2 reveals, the die gap opening 8 advantageously has a shape adapted to the contour of the strip conductor 5. The consequently largely rectangular opening with rounded portions at the corners is spaced away from the surfaces of the strip conductor by distances a1 and a2 and is fixed by gap widths w1 and w2 and by radii of curvature R1 and R2 in its corner regions. The distances (a1, a2) of the die gap opening 8 from the strip conductor 5, its geometrical shaping (w1, w2, R1, R2) and the advancing rate v of the conductor determine the contour of the sheathing 4 and its thickness d. The geometrical shaping of the extrusion die may in this case, as assumed for the exemplary embodiment according to FIG. 2, be chosen such that the thickness d of the sheathing 4 is approximately equal on all sides. In this case, a thickness d of less than 0.5 mm is generally planned, for example between 30 and 300 $\mu$m.

As a departure from this, it is possible by different shaping of the extrusion die opening, for example a2<a1 and w1<w2, to bring about the effect that side lips form on the narrow sides of the conductor. Such side lips can then be used as spacers during the production of layer windings and consequently dispense with the need for additional winding at the same time of special spacers, such as for example of glass twine. The contour of the outlet opening 8 of the die gap may also be structured to the effect that a non-uniform thickness of the sheathing is obtained on at least one side of the conductor. In this way it is possible to obtain, for example, by means of a channel-like depression in the contour of the opening 8, a web-like bead of the sheathing, which can then serve as a spacer. Furthermore, it is also possible, if need be, to dispense with an exactly central guidance of the superconductor through the guide channel 3, in order in this way to produce a sheathing that is thicker on one or two sides.

All thermoplastic materials which on the one hand have a processing or melting temperature which rules out any detrimental effect on the superconducting properties of the HTS conductor 5 to be sheathed and nevertheless ensures sufficient plasticity for the extrusion coating method come into consideration for the sheathing 4. It has surprisingly been found that known HTS strip conductors with filaments of Bi cuprate material which are embedded in an Ag matrix withstand temperature loads of over 500° C. for several minutes without any detrimental effect on their superconducting properties. A corresponding, actual standard HTS strip conductor, taken as a basis for the considerations below, is known from "IEEE Transactions on Applied Superconductivity", Vol. 9, No. 2, June 1999, pages 2480 to 2485. It has an Ag matrix surrounded by an AgMg shell with 55 conductor cores or filaments of the high-$T_c$ superconductor material $(Bi,Pb)_2Sr_2Ca_2Cu_3O_x$ (known as "BPSCCO-2223" HTS material) incorporated therein and twisted with respect to one another. Its outer dimensions (without insulation) are 3.6×0.26 mm$^2$.

According to the invention, thermoplastic materials of which the processing temperature lies above 200° C. and can be a maximum of 500° C. are preferably chosen for such an HTS strip conductor. Such materials which make processing possible in a temperature range between 220° C. and 450° C., in particular between 240° C. and 420° C., preferably between 250° C. and 380° C., are advantageously selected. The selection of thermoplastics for this temperature range is particularly large. Correspondingly suitable materials are, in particular, engineering thermoplastics known per se from the family of polyamides or polyesters, which are to be provided with preference for the lower part of the stated temperature range (approximately between 200° C. and 290° C.). To be regarded as also particularly suitable, in particular for the upper part of the temperature range, are special high-temperature (HT) thermoplastics, such as a polyether imide (PET) or a polyether sulfone (PES) or a polysulfone (PSU) or a polyphenylene sulfone (PPSU) or a polyether ether ketone (PEEK).

The actual selection of the thermoplastic insulating materials is additionally made from the aspect that the thermoplastics used have sufficiently good low-temperature properties, to be able in this way to rule out failures under operating conditions and/or during cooling-down and heating-up processes.

If transparent insulating materials are used, the insulating sheath may be additionally colored with dyes. As a result, easy visual inspection of the sheathing is possible.

The thin-film extrusion coating method according to an embodiment of the invention is particularly suitable for sheathing HTS conductors in strip form of which the conductor strip thickness lies below 1.5 mm, preferably below 0.5 mm, and which have a high aspect ratio of at least 3, preferably at least 10.

A corresponding HTS strip conductor may have, for example, a width of 3.6 mm and a thickness of 0.25 mm and a thickness of 0.25 mm and may be, in particular, the aforementioned standard HTS strip conductor.

In principle, all known oxidic superconductor materials with a high transition temperature, which in particular allow an $LN_2$ cooling technique, come into consideration as HTS materials. To be regarded as particularly suitable here, however, are Bi cuprate materials which primarily contain the so-called 2212 phase (80 K phase) or preferably the so-called 2223 phase (110 K phase) at least in a predominant part (cf. for example "IEEE Transactions on Applied Superconductivity", Vol. 7, No. 2, June 1997, pages 355 to 358). The Bi cuprate material may in this case additionally contain Pb (known as "BPSCCO").

HTS conductors in strip form with sheathings produced according to the invention are also usually provided with an additional ceramic surface coating, which is intended to prevent sintering of the actual, metallic outer sides or surfaces of the conductor, which consist with preference of Ag or an Ag alloy, such as AgMg, during required reaction annealing operations.

Figure 3:
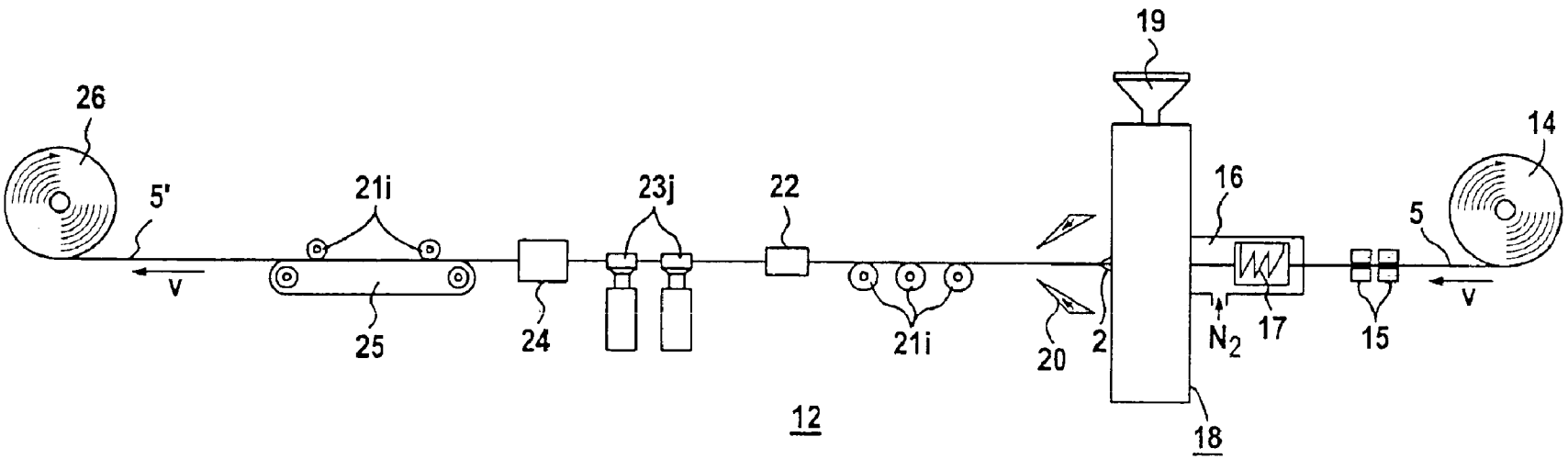

According to an actual exemplary embodiment, a corresponding 2223-BPSCCO/Ag standard strip conductor was sheathed with a thermoplastic material according to the invention. A corresponding coating installation is indicated in FIG. 3. This installation, denoted generally by 12, has the following parts one after the other, seen in the strip guiding direction v, to be specific an unwinding device (so-called "unwinder") 14, from which the HTS strip conductor 5 to be coated is unwound, a felt brake 15, an $N_2$ inert gas purging means 16 to avoid oxidation, a contactless inductive conductor heater 17, to heat up the conductor at least approximately to the processing temperature of the thermoplastic insulating material used, such as for example a thermoplastic polyurethane elastomer, an extrusion coating device (so-called "extruder") 18 with a replenishing hopper 19 for the thermoplastic insulating material, an extrusion head with a built-in extrusion die 2, an air cooling device 20, a plurality of guide rollers 21*i*, a pore detector 22 for monitoring the applied sheathing, at least one cold-air blower 23*j*, a nondestructive insulating-layer thickness monitoring device 24, a strip take-off 25 and a power-controlled winding device (so-called "winder") 26 for taking up the strip conductor 5' provided with the sheathing of the solidified or cooled-down thermoplastic polyurethane elastomer.

In this case, the thickness d of the sheathing can also be influenced by the choice of a suitable strip take-off rate. For example, at a conductor run-through rate of approximately 5 m/min, a sheathing with a thickness of approximately 30 $\mu$m can be produced. To improve the bonding of the sheathing on the surface of the conductor, the conductor is inductively preheated by means of the conductor heater 17, in particular at least approximately to a temperature level close to the processing temperature (i.e., if need be, slightly above or below it, for example +/−50° C.). This preheating of the conductor, which is only required briefly and therefore does not damage the superconductor material, advantageously takes place under an inert gas atmosphere, to avoid oxide formations on the surface of the conductor, which may have adverse effects on the bonding of the insulating sheathing layer on the conductor. Possible preheating of a conductor is indeed known in principle; however, the previously used preheating temperatures are significantly lower than the processing temperatures of the chosen thermoplastics to be provided for the HTS conductors.

To ensure a really good adhesive bond of the insulating material on the conductor, it is expedient for the conductor to be preheated to a temperature that is as high as possible but without any damage occurring to the HTS conductor with respect to its superconducting properties. When a hot thermoplastic melt comes into contact with an inadequately preheated conductor, there could otherwise be an undesired immediate solidification and hardening of the melt on the contact surface; and adequate wetting of the surface of the conductor by the melt would consequently be prevented. However, good wetting is a precondition for the forming of an adhesive bond. This bonding is supported by the mentioned negative pressure in the stretched cone.

During the subsequent coating process, the air nozzles of the air cooling device 20 that are fitted behind the extruder 18, a counterflow cooler that is possibly also present and the blower 23*j* serve for the faster cooling and setting of the applied sheathing layer of the thermoplastic insulating material. There is also an online check for insulation defects by a nondestructively operating pore detector 32 and a monitoring of the applied insulating layer thickness, for example by means of a laser arrangement 24. On account of the rapid cooling and setting of the sheathing, sticking of the sheathings during the subsequent winding-up of the conductor 5' on the winder 26 can be prevented. In that case, a separating layer, for example of paper, can be additionally wound as a liner with the conductor onto the winder 26 serving as a supply reel, in order to rule out sticking of the conductor during storage. Instead of this, the sheathing of the conductor may be provided with a powder suitable for this, for example of talc.

Some actual exemplary embodiments within the scope of the method according to an embodiment of the invention are presented below:

EXAMPLE 1

Applying the Insulating Layer on the Basis of the Method Described Above with Insulation of PEEK processing temperature of melt: 380° C.

conductor preheating: 375° C.

insulation of PEI processing temperature of melt: 370° C.

conductor preheating: 370° C.

insulation of PPSU processing temperature of melt: 375° C.

conductor preheating: 370° C.

EXAMPLE 2

Layer Thickness of the Applied Insulation

| PEEK Conductor 1 | PEEK Conductor 2 | PEI | PPSU | EVA |
|---|---|---|---|---|
| 25 $\mu$m | 15 $\mu$m | 30 $\mu$m | 25 $\mu$m | 50 $\mu$m |

EXAMPLE 3

Bonding of Insulation Impregnating Resin (Stycast 1266)

PEEK/Stycast 1266: separation only possible by tearing the insulation off the conductor PEI/Stycast 1266: separation only possible by tearing the insulation off the conductor PPSU/Stycast 1266: separation only possible by tearing the insulation off the conductor EVA/Stycast 1266: easy separation without destruction of the conductor insulation

EXAMPLE 4

Electrical Properties at 77 K in Liquid Nitrogen

DC Insulation Tests

| | Partial discharge conductor/conductor | Breakdown conductor/conductor | Partial discharge conductor/edge | Breakdown conductor/edge |
|---|---|---|---|---|
| PEEK (25 μm) | 5500 V | 15000 V | 3000 V | 4000 V |
| PPSU (25 μm) | 3200 V | 12000 V | 2500 V | 6300 V |
| EVA (50 μm) | 3000 V | 8000 V | 2700 V | 3500 V |

AC Insulation Tests

| | Breakdown conductor/conductor | Breakdown conductor/edge |
|---|---|---|
| PEEK (25 μm) | 4.7 kVrms | 3.2 kVrms |
| PPSU (25 μm) | 5.0 kVrms | 3.5 kVrms |
| EVA (50 μm) | 4.2 kVrms | 2.8 kVrms |

The EVA values presented above in this case represent comparative values obtained within the scope of the method proposed by the WO document cited at the beginning.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing a sheathing around at least one high-$T_c$-superconductor in strip form with an aspect ratio of at least 3, the method comprising:

heating the superconductor at least approximately to a process temperature between 200° C. and 500° C. before and during introduction into a guide channel of a die;

extruding a melt tube of molten thermoplastic insulating material from the die, the outlet opening of which surrounds the superconductor at a distance on all sides;

stretching the melt tube and drawing it onto a surface of the superconductor as the superconductor is advanced outside of the die, wherein a sheathing with an average thickness of less than 100 μm is formed; and setting the melt tube, applied in this way to the surface of the superconductor, by cooling, wherein a thermoplastic material with said process temperature is provided as the insulating material.

2. The method as claimed in claim 1, wherein the thermoplastic material includes a process temperature between 240° C. and 420° C.

3. The method of claim 2, wherein the thermoplastic material includes a process temperature between 250° C. and 380° C.

4. The method as claimed in claim 2, wherein at least one of a polyamide and a polyester is provided as the insulating material.

5. The method as claimed in claim 2, wherein the insulating material includes at least one of a polyether de (PEI), a polyether sulfone (PES), a polysulfone (PSU), a polyphenylene sulfone (PPSU) and a polyether ether ketone (PEEK).

6. The method as claimed in claim 1, wherein at least one of a polyamide and a polyester is provided as the insulating material.

7. The method as claimed in claim 1, wherein the insulating material includes at least one of a polyether imide (PEI), a polyether sulfone (PES), a polysulfone (PSU), a polyphenylene sulfone (PPSU) and a polyether ether ketone (PEEK).

8. The method as claimed in claim 1, wherein the guide channel is heated up.

9. The method as claimed in claim 8, wherein the superconductor is heated up under an inert gas atmosphere.

10. The method as claimed in claim 1, wherein the superconductor is heated up under an inert gas atmosphere.

11. The method as claimed in claim 1, wherein space inside the tube is evacuated to bring the melt tube onto the surface of the superconductor.

12. The method as claimed in claim 1, wherein the melt tube is stretched by a degree of stretching of between 5 and 15.

13. The method as claimed in claim 1, wherein the superconductor emerging from the die, provided with the sheathing, is subjected to a cooling treatment.

14. The method as claimed in claim 1, wherein an outlet opening of the die is shaped such that its spacing with respect to the superconductor is non-uniform, as seen in the circumferential direction of the superconductor.

15. The method of claim 1, wherein the method is for sheathing a superconductor in strip form with a strip thickness of at most 1.5 mm.

16. The method of claim 1, wherein the method is for sheathing a superconductor with a plurality of superconductor cores of the high-$T_c$ superconductor material, embedded in a normally conducting material.

17. A method of claim 1, wherein the at least one superconductor is at least one of a multiple superconductor and a composite superconductor with superconducting individual superconductor of the aspect ratio of at least 3, each of which contains a superconducting conductor core of the high-$T_c$ superconductor material embedded a normally conducting material.

18. The method of claim 17, wherein the method is for sheathing a superconductor in strip form with a sheathing, of which the thickness on at least two sides of the superconductor amounts at most to 0.03 mm.

19. The method of claim 17, wherein the method is for sheathing a superconductor in strip form with a sheathing, of which a thickness on relatively narrow sides of the superconductor is relatively greater than on relatively wide sides.

20. The method of claim 17, wherein the method is for sheathing at least one superconductor with a superconductor material of a Bi cuprate, which is embedded in normally conducting material at least containing Ag.

21. The method of claim 17, wherein the method is for sheathing each individual superconductor in strip form serving for the construction of a Roebel bar superconductor.

22. The method of claim 1, wherein the at least one superconductor is at least one of a multiple superconductor and a composite superconductor with superconducting individual superconductors, of the aspect ratio of at least 3, each of which contains a plurality of superconductor cores of the high-$T_c$ superconductor material embedded in a normally conducting material.

23. The method of claim 22, wherein the method is for sheathing a superconductor in strip form with a sheathing, of which the thickness on at least two sides of the conductor amounts at most to 0.03 mm.

24. The method of claim 22, wherein the method is for sheathing a superconductor in strip form with a sheathing, of which a thickness on relatively narrow sides of the conductor is relatively greater than relatively wide sides.

25. The method of claim 22, wherein the method is for sheathing at least one superconductor with a superconductor material of a Bi cuprate, which is embedded in normally conducting material at least containing Ag.

26. The method of claim 22, wherein the method is for sheathing each individual superconductor in strip form serving for the construction of a Roebel bar conductor.

27. The method of claim 1, wherein the method is for sheathing a superconductor in strip form with a sheathing, of which the thickness on at least two sides of the superconductor amounts at most to 0.03 mm.

28. The method of claim 1, wherein the method is for sheathing a superconductor in strip form with a sheathing, of which a thickness on relatively narrow sides of the superconductor is relatively greater than on relatively wide sides.

29. The method of claim 1, wherein the method is for sheathing at least one superconductor with a superconductor material of a Bi cuprate, which is embedded in normally conducting material at least containing Ag.

30. The method of claim 1, wherein the method is for sheathing each individual superconductor in strip form serving for the construction of a Roebel bar superconductor.

31. The method of claim 1, wherein the thermoplastic material includes a process temperature between 220° C. and 450° C.

32. The method of claim 1, wherein the sheathing is made of an electrical insulating material of plastic on all sides.

33. The method of claim 1, wherein the method is for a continuous sheathing process at a process temperature having virtually no detrimental effect on the superconducting properties of the superconductor.

34. The method as claimed in claim 1, wherein a sheathing with an average thickness of at most 30 $\mu$m is formed.

35. A method of claim 1, wherein the superconductor in strip form has an aspect ratio of at least 10.

36. The method of in claim 1, wherein the method is for sheathing a superconductor in strip form with a strip thickness of at most 0.5 mm.

37. The method of claim 15, wherein the method is for sheathing a superconductor with a plurality of superconductor cores of the high-$T_c$ superconductor material, embedded in a normally conducting material.

38. The method of claim 1, wherein the superconductor includes oxidic high-$T_c$ superconductor material.

39. The method of claim 1, wherein the step of extruding occurs after the superconductor emerges from a guide channel.

* * * * *